US005704822A

United States Patent [19]

Nilsson

[11] Patent Number: 5,704,822

[45] Date of Patent: Jan. 6, 1998

[54] SWITCHING DEVICE FOR A TOY RAILWAY

[75] Inventor: Sven-Erik Nilsson, Osby, Sweden

[73] Assignee: Brio AB, Osby, Sweden

[21] Appl. No.: 640,731

[22] PCT Filed: Oct. 7, 1994

[86] PCT No.: PCT/SE94/00937

§ 371 Date: May 6, 1996

§ 102(e) Date: May 6, 1996

[87] PCT Pub. No.: WO95/13852

PCT Pub. Date: May 26, 1995

[51] Int. Cl.[6] ..... A63H 19/28; A63H 18/00; B61C 9/00

[52] U.S. Cl. ..... 446/447; 446/444; 104/130.01; 246/415 A

[58] Field of Search ..... 446/444, 447, 446/446, 445, 431, 437; 104/130.01, 130.06, 130.09; 246/415 A; 238/10 A, 10 F

[56] References Cited

U.S. PATENT DOCUMENTS 2,154,450 4/1939 Holt .

FOREIGN PATENT DOCUMENTS 3 0490 98 7/1982 Germany .

*Primary Examiner*—D. Neal Muir

*Attorney, Agent, or Firm*—Barnes, Kisselle, Raisch, Choate, Whittemore & Hulbert, P.C.

[57] ABSTRACT

A switching device (5) is arranged in a junction element (1), which is to be used in a toy railway and is in the form of a reversible plate. On each flat side, this plate is formed with depressions (2, 2', 2"), which in pairs form an incoming railway track (2) and two outgoing railway tracks (2', 2") extending therefrom. On each flat side, the switching device (5) has a switch plate (6) which is arranged in a recess (7) formed in the respective flat sides and which is pivotable between a first position and a second position, in which it produces a track connection between the incoming railway track (2) and the one or the other of the outgoing railway tracks (2', 2"). The switch plates (6) are interconnected by means of a connecting element (12), which extends through a profile hole (16) in the junction element (1) and which, when the switch plates (6) occupy the first and the second position, engages a first and a second portion (16', 16"), respectively, of a wall delimiting the profile hole (16). The switch plates (6) can be pivoted by axial displacement of an operating rod (17) which, with force fit, extends through a hole (18) in the junction element (1) from the outside thereof into the profile hole (16), where it is connected to the connecting element (12).

4 Claims, 2 Drawing Sheets

SWITCHING DEVICE FOR A TOY RAILWAY

BACKGROUND OF THE INVENTION

This invention relates to a switching device which is arranged in a junction element to be used in a toy railway.

A prior-art junction element, which is provided with a switching device, has two opposing, parallel flat sides, of which the one constitutes its upper side and the other constitutes its underside. On the upper side, this junction element is formed with track-like depressions, which in pairs form an incoming railway track and two outgoing railway tracks extending therefrom for a toy train. The junction element is intended to be placed on a flat surface with its upper side, i.e. the side with the tracks, facing upwards. The switching device comprises a switch plate, which is pivotably arranged at the upper side of the junction element. The switch plate can be pivoted so as to produce a track connection between the incoming railway track and the one or the other of the outgoing railway tracks. Further, the switch plate can be pivoted by means of an eccentric element projecting from the upper side of the junction element and consisting of a pivot pin that is eccentrically mounted in the upper side of the junction element.

SUMMARY OF THE INVENTION

A switching device of the type described above cannot be used in association with a reversible junction element, by which is meant a junction element whose two flat sides are both formed with track-like depressions and thus form "track sides".

The object of this invention is to provide a simple and reliable switching device for such a reversible junction element.

According to the invention, this object is achieved by a switching device arranged in a junction element, which is to be used in a toy railway and which has two opposing, parallel flat sides and is reversible so that it can be placed on a flat surface, with either of said flat sides facing upwards, each flat side being formed with track-like depressions, which in pairs form one incoming railway track and two outgoing railway tracks extending therefrom for a toy train, said switching device being characterised in that it is provided with a switch plate at each flat side, said switch plate being arranged in a recess, which is formed in the respective flat sides and in which the switch plate is pivotable about a pivot axis perpendicular to the flat sides between a first position, in which it produces a track connection between the incoming railway track and the one outgoing railway track, and a second position, in which it produces a track connection between the incoming railway track and the other outgoing railway track, that the two switch plates are interconnected by a connecting element, which extends through a profile hole formed in the junction element and which, when the switch plates occupy the first position, engages a first portion of a wall delimiting the profile hole and, when the switch plates occupy the second position, engages a second portion of said wall, and that the switch plates can be pivoted by axial displacement of an operating rod which with force fit extends through a hole, which is formed in the junction element and is essentially perpendicular to the pivot axis of the switch plates, from the outside of the junction element into the profile hole, where it is connected to the connecting element.

In a preferred embodiment, the operating rod has, over at least part of its length, a slightly larger cross-section than the hole, and the operating rod in this part has a longitudinal, through slit that enables it to be elastically compressed in the hole.

In another preferred embodiment, the pivot axis of the switch plates is defined by a pivot pin which is rotatably mounted in the junction element, and the pivot pin and the connecting element are connected with press fit to the two switch plates by means of hole-and-pin connections.

In yet another preferred embodiment, the operating rod has a conical recess in the portion located in the profile hole, and the connecting element has a projecting pin engaging in this recess in order to connect the connecting element to the operating rod.

The invention will now be described in more detail with reference to the accompanying drawings illustrating a preferred embodiment of the switching device. In the drawings,

DESCRIPTION OF THE PREFERRED EMBODIMENT

Figure 2:
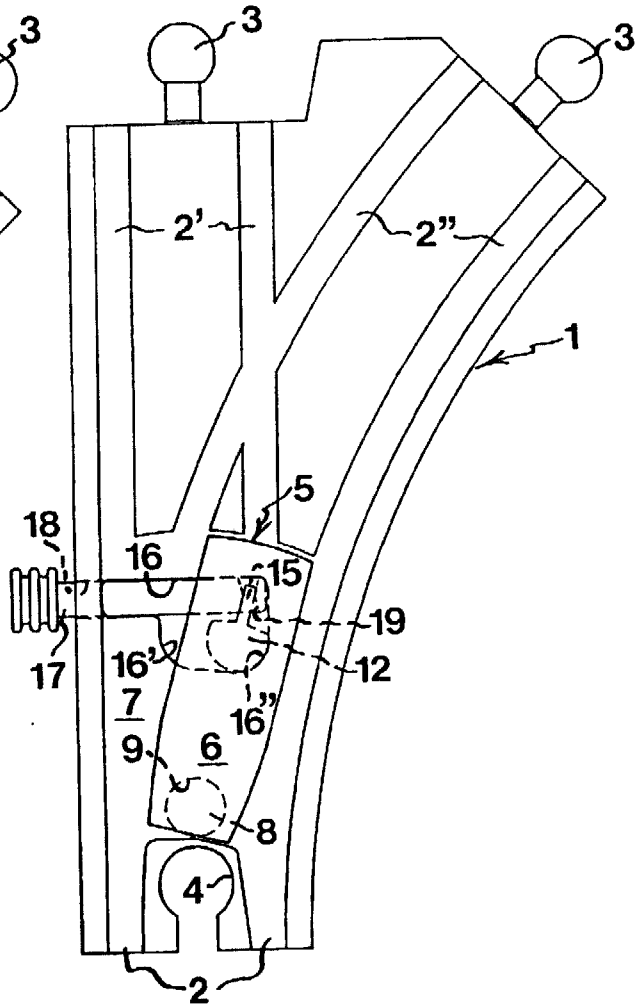
FIG. 2 is similar to FIG. 1 but shows the switch plates of the switching device in a second position.
Figure 1:
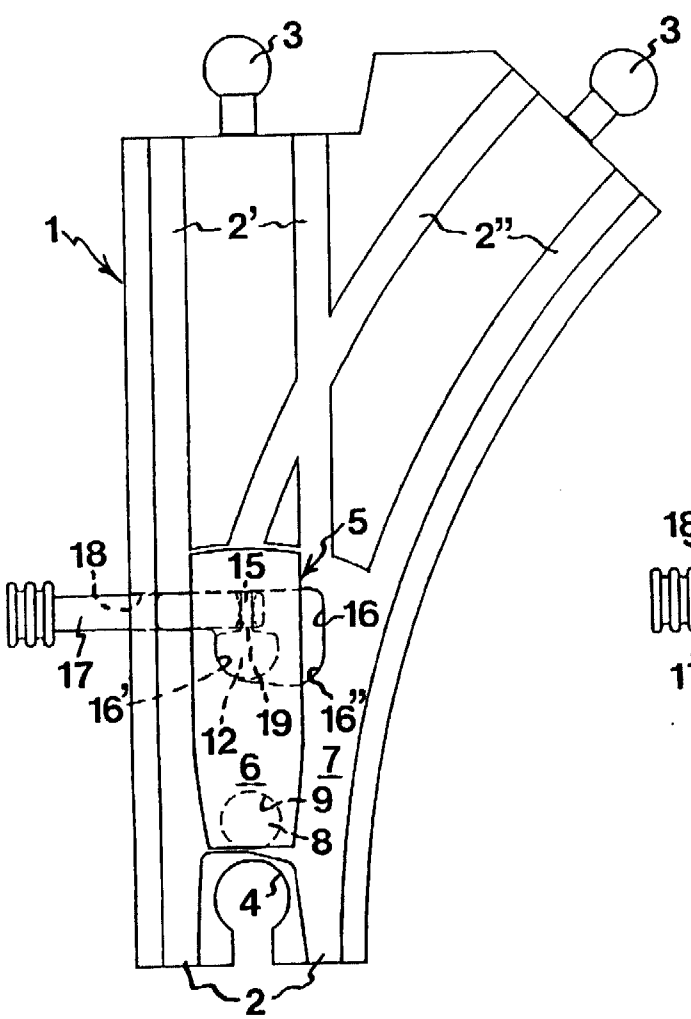
FIG. 1 is a top plan view showing a junction element provided with a switching device according to the invention, the switch plates of the switching device being in a first position.
Figure 3:
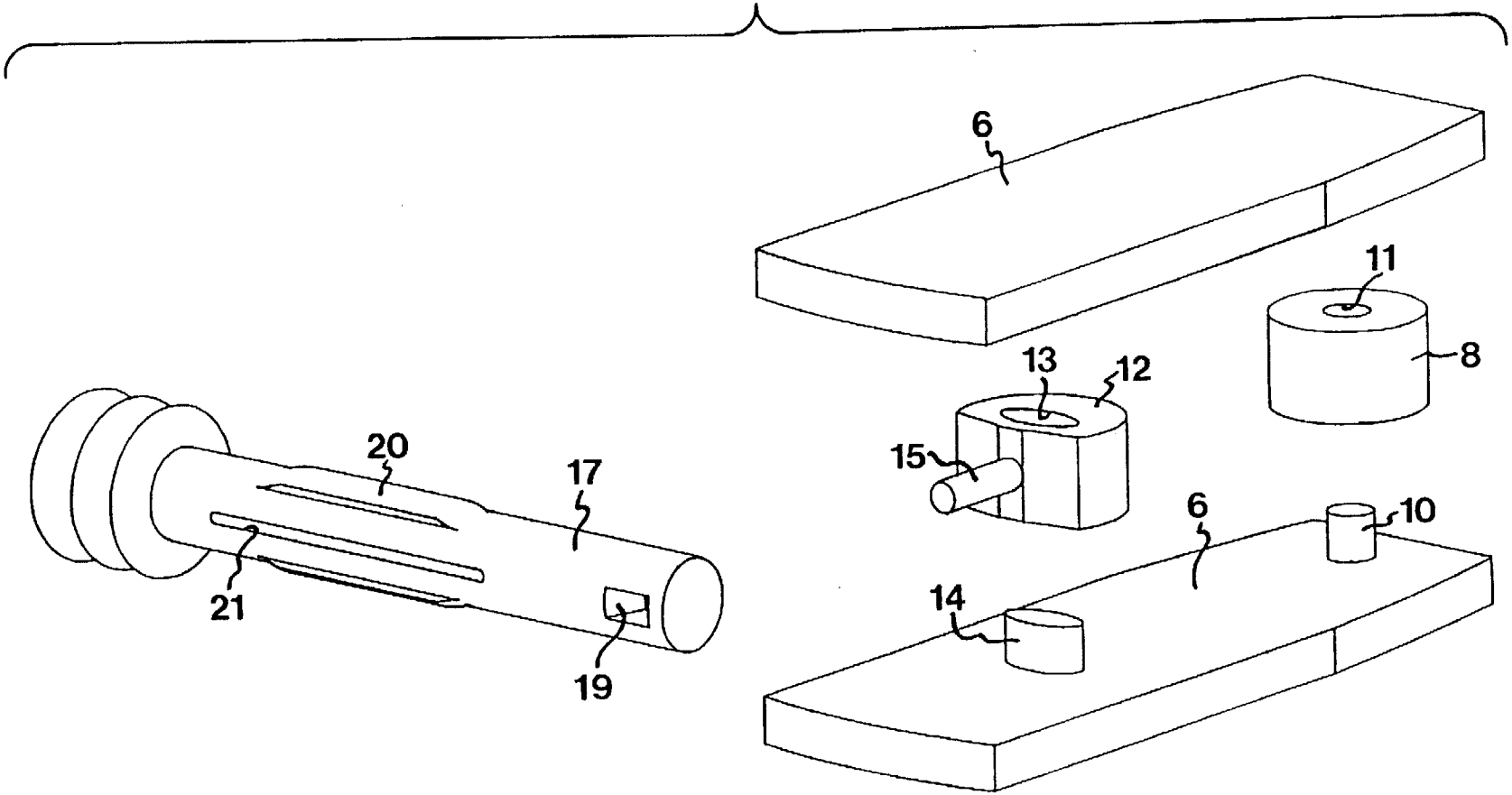
FIG. 3 is an exploded view showing the components forming the switching device.

The junction element 1 shown in FIGS. 1 and 2 is a platelike wooden element having two opposing, parallel flat sides. Each flat side is formed with track-like depressions 2, 2' and 2", which in pairs form an incoming railway track 2 and two outgoing railway tracks 2' and 2" extending therefrom. Since FIGS. 1 and 2 show only the one flat side of the junction element 1, it should be observed that the other flat side is of identical design. The junction element 1 is reversible, and may be utilised with any one of the two flat sides facing upwards.

The junction element 1 is provided with coupling means 3 and 4, by means of which it can be coupled in known fashion to other wooden elements (not shown) equipped with corresponding coupling means. These other wooden elements are also provided with track-like depressions forming railway tracks. Thus, wooden elements of this type are interconnected to form a toy railway for a toy train. The engine, carriages and wagons of the toy train run on wheels travelling in the railway tracks formed by the depressions in the wooden elements.

The illustrated junction element 1 is provided with a switching device 5 according to the invention.

At each of the two flat sides of the junction element 1, the switching device 5 comprises a switch plate 6 which is arranged in a recess 7 formed in the respective flat sides and having the same depth as the depressions 2, 2' and 2". Thus, the bottom of the recess 7 is located on the same level as the bottom of the depressions 2, 2' and 2". The two switch plates 6 are pivotable about a common axis perpendicular to the flat sides and defined by a pivot pin 8, which is in the form of a circular sleeve. The sleeve 8 is rotatably arranged in a through hole 9 which is provided in the junction element 1 and located in the vicinity of the incoming railway track 2, halfway between the extensions of the two track-like depressions thereof. The switch plates 6 are non-rotatably connected to the sleeve 8 and are, to this end, each provided with a pin 10 which is inserted in the centre hole 11 of the sleeve 8 with press fit. The switch plates 6 are pivotable between a first position, which is shown in FIG. 1 and in which the plates produce a track connection between the incoming railway track 2 and the one outgoing railway track 2' at the respective flat sides, and a second position, which is shown in FIG. 2 and in which the plates produce a track connection between the incoming railway track 2 and the other outgoing railway track 2" at the respective flat sides. As appears from FIGS. 1 and 2, the width of the switch plates 6 equals the distance between the inner edges of the depressions 2, 2' and 2" forming the railway tracks. As is also shown in the drawings, the width of the switch plates 6 decreases somewhat at the end portion closest to the sleeve 8 in the direction of the incoming railway track 2, thereby to prevent any formation of lugs that may obstruct the passage of the engine and/or the carriage or wagon wheels.

Furthermore, the two switch plates 6 are interconnected by a connecting element 12, which is in the form of a sleeve whose through hole 13 is of oval cross-sectional shape. Each of the switch plates 6 is equipped with a pin 14 which has a cross-sectional shape corresponding to that of the hole 13 and which is inserted in the hole 13 with press fit. The connecting element 12 has a pin 15 projecting in parallel with the switch plates 6 in their longitudinal direction. The connecting element 12 is positioned in a profile hole 16 extending through the junction element 1 in the area of its two recesses 7.

An operating rod 17 extends through a hole 18, which is provided in the junction element 1 and is perpendicular to the pivot axis of the switch plates 6, from the outside of the junction element into the profile hole 16. Close to its inner end, the operating rod 17 has a through hole 19, which widens outwards at its two openings. The pin 15 of the connecting element 12 extends into the hole 19 and thus connects the switch element formed of the switch plates 6, the pivot pin 8 and the connecting element 12 to the operating rod 17. As a result, the switch plates 6 can be pivoted by axial displacement of the operating rod 17 so as to occupy their first position (FIG. 1) when the operating rod 17 is in pulled-out position, and so as to occupy their second position (FIG. 2) when the operating rod 17 is in inserted position. When the switch plates 6 occupy their first position and the operating rod 17 thus is in pulled-out position, the connecting element 12 engages a first portion 16' of the wall delimiting the profile hole 16. When the switch plates 6 occupy their second position and the operating rod 17 thus is in inserted position, the connecting element 12 engages a second portion 16" of this wall.

Over part 20 of its length, the operating rod 17 has a slightly larger cross-section than the hole 18. In this part 20, the operating rod 17 is formed with a longitudinal slit 21 enabling it to be elastically compressed in the hole 18. Thus, the operating rod 17 extends with force fit through the hole 18. As a result, the switch will be reliable in the sense that the switch plates 6 are securely retained in the set, pivotal position.

The components forming the switching device 5 proper, i.e. the two plates 6, the pivot pin 8, the connecting element 12 and the operating rod 17, are preferably made of plastics material.

I claim:

1. A switching device arranged in a junction element (1), which is to be used in a toy railway and which has two opposing, parallel flat sides and is reversible so that it can be placed on a flat surface, with either of said flat sides facing upwards, each flat side being formed with track-like depressions (2, 2', 2"), which in pairs form one incoming railway track (2) and two outgoing railway tracks (2', 2") extending therefrom for a toy train, characterised in that it is provided with a switch plate (6) at each flat side, said switch plate being arranged in a recess (7), which is formed in the respective flat sides and in which the switch plate (6) is pivotable about a pivot axis perpendicular to the flat sides between a first position, in which it produces a track connection between the incoming railway track (2) and the one outgoing railway track (2'), and a second position, in which it produces a track connection between the incoming railway track (2) and the other outgoing railway track (2"), that the two switch plates (6) are interconnected by a connecting element (12), which extends through a profile hole (16) formed in the junction element (1) and which, when the switch plates (6) occupy the first position, engages a first portion (16') of a wall delimiting the profile hole (16) and, when the switch plates (6) occupy the second position, engages a second portion (16") of said wall, and that the switch plates (6) can be pivoted by axial displacement of an operating rod (17) which with force fit extends through a hole (18), which is formed in the junction element (1) and is essentially perpendicular to the pivot axis of the switch plates (6), from the outside of the junction element (1) into the profile hole (16), where it is connected to the connecting element (12).

2. A switching device as set forth in claim 1, characterised in that the operating rod (17) has, over at least part (20) of its length, a slightly larger cross-section than the hole (18), and that the operating rod (17) in this part has a longitudinal, through slit (21) that enables it to be elastically compressed in the hole (18).

3. A switching device as set forth in claim 1, characterised in that the pivot axis of the switch plates (6) is defined by a pivot pin (8) which is rotatably mounted in the junction element (1), and that the pivot pin (8) and the connecting element (12) are connected with press fit to the two switch plates (6) by means of hole-and-pin connections (10, 11 and 13, 14, respectively).

4. A switching device as set forth in any one of claims 1–3, characterised in that the operating rod (17) has a conical recess (19) in the portion located in the profile hole (16), and that the connecting element (12) has a projecting pin (15) engaging in this recess (19) in order to connect the connecting element (12) to the operating rod (17).

* * * * *

UNITED STATES PATENT AND TRADEMARK OFFICE

CERTIFICATE OF CORRECTION

PATENT NO. : 5,704,822

DATED : January 6, 1998

INVENTOR(S) : Sven-Erik Nilsson

It is certified that error appears in the above-indentified patent and that said Letters Patent is hereby corrected as shown below:

On the Cover Page of Patent insert -

Foreign Application Priority Data

Nov. 19, 1993 (SE) Sweden 9303841-2

Signed and Sealed this

Twenty-fourth Day of March, 1998

*Attest:*

*Attesting Officer*

BRUCE LEHMAN

*Commissioner of Patents and Trademarks*